United States Patent [19]

Gamble

[11] 4,321,759

[45] Mar. 30, 1982

[54] BODY BOLT ADAPTER FOR HEATED CAN ROLLS OF HIGH THERMAL EFFICIENCY

[76] Inventor: James E. Gamble, Box 18, Den Rd., Lincoln University, Pa. 19352

[21] Appl. No.: 178,888

[22] Filed: Aug. 18, 1980

Related U.S. Application Data

[63] Continuation-in-part of Ser. No. 942,942, Sep. 18, 1978.

[51] Int. Cl.[3] ..... F26B 13/08

[52] U.S. Cl. ..... 34/110; 165/89; 165/146

[58] Field of Search ..... 24/243 B; 85/32 K; 151/41.74, 41.76, 44; 34/110, 108; 165/89, 146, 185; 100/93 RP; 29/110, 118, 119; 162/375, 378, 379, 207; 432/10, 60, 253, 255.1; 411/373, 374, 104

[56] References Cited

U.S. PATENT DOCUMENTS 4,241,518 12/1980 Alexy ..... 34/110

*Primary Examiner*—Larry I. Schwartz

*Attorney, Agent, or Firm*—E. Leigh Hunt

[57] ABSTRACT

Disclosed is an improved heated can roll of high thermal efficiency for web or sheet processing machines, such as a papermaking machine. The improved can roll has means for insulating the ends of the internally heated can rolls to provide a segmental heat insulating part spaced from the roll end or head to provide an air space adjacent to the head or roll ends, resulting in a large reduction in heat loss through natural convection, convection due to rotation, forced convection due to air draft, and radiation and resulting in a more uniform drying surface temperature. Improved clip means using a body bolt adapter are provided for attaching the insulating means directly onto the existing head bolts holding the can roll head onto the cylindrical portion of the can roll.

8 Claims, 12 Drawing Figures

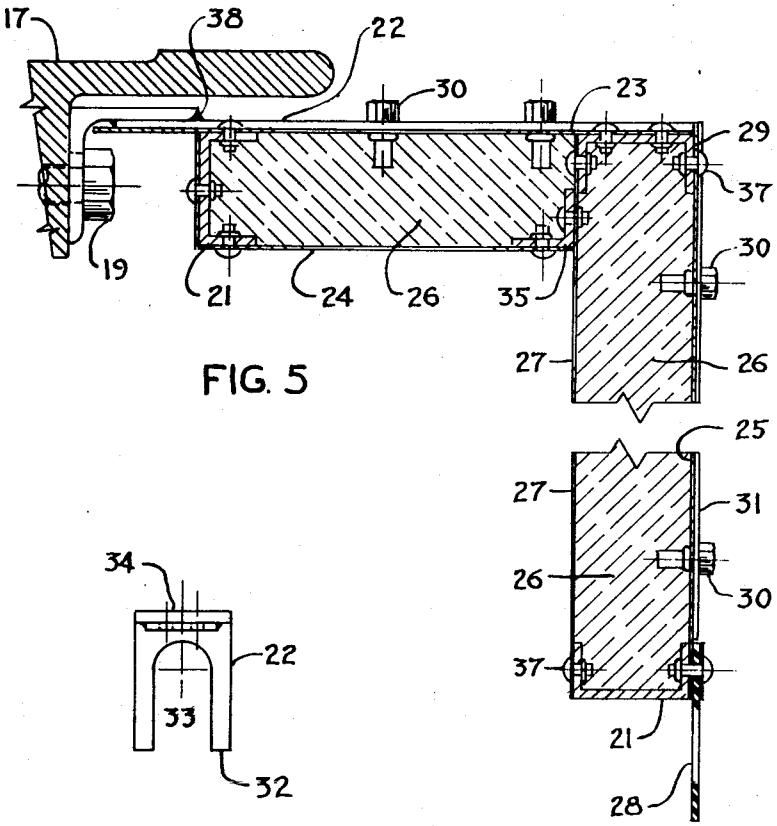
FIG. 5
FIG. 6
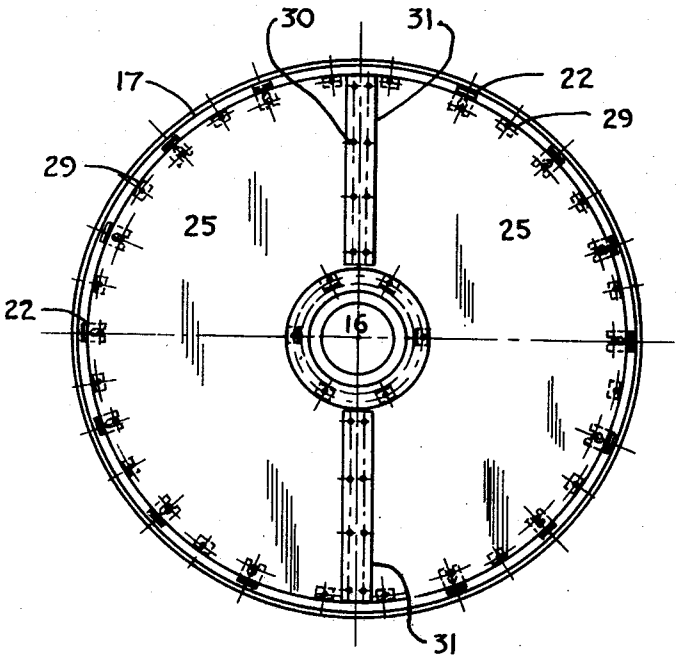
FIG. 4

BODY BOLT ADAPTER FOR HEATED CAN ROLLS OF HIGH THERMAL EFFICIENCY

RELATIONSHIP TO OTHER APPLICATIONS

This application is a continuation-in-part application of my allowed United States Application Ser. No. 942,942, filed Sept. 18, 1978.

BACKGROUND OF THE INVENTION

Nature of the Invention

This invention is an improvement in internally steam heated can rolls in a web processing machine, such as a papermaking machine. The invention involves means for reducing heat losses in all forms from the heads, or end enclosures, from the can roll to provide a marked increase in thermal efficiency. The invention is particularly adaptable for modification of existing sheet or web processing machines as all parts can be affixed to the roll by attachment to existing head bolts that bolt the heads onto the cylindrical shell of the roll. Thus, a minimum of downtime and other expense is expended in order to utilize the invention with respect to existing machines. Also, since these are generally "coded" pressure vessels, to drill or tap additional bolts into the roll would require recertification of the vessel—if such certification would then be possible.

The paper industry is one of the largest industries with respect to consumption of energy in the world. A sizable portion of this energy is wasted from the heads of the drying sections of the papermaking equipment.

The mechanism of heat losses from the outside surface of the heads of the associated can rolls is a combination of radiation and various forms of convection. Radiative losses due to the surface emission of heat are about 10% of the total losses. Convection losses are best considered as comprising three components. The primary mode is the convection as a result of external air draft provided to aid in driving out the moisture from a web being dried. A secondary contribution to convection comes from the relative air movement generated by the rotation of the dryer roll head itself, which at moderate operating speeds has a similar magnitude of heat loss as from the radiative losses above. The final component is the natural free convection resulting from the temperature differential between the external surface of the head and the ambient air.

Typically, with a 60 inch diameter can roll operating at 1200 feet per minute using 300° F. steam, the radiative loss, natural convection loss, and convection due to rotation are of similar orders of magnitude and generally total less than about 30% of the total head heat loss. Heat loss from the shaft itself is generally less than about 7%. The balance of the heat loss, which is generally greater than two-thirds of the total loss from the heads, is from the forced convection due to air draft.

As is seen from FIG. 7, herein, the practice of this invention at today's energy cost, can commonly result in annual energy savings of up to $14,000 (dollars) per head, depending upon precise operating conditions. One papermaking machine may have more than twenty such can rolls.

Another invention is a body bolt adapter comprising at least a portion of the clip means that is useful for attaching the head member insulating assembly to head bolts that normally protrude from existing head members.

Description of the Prior Art

Various types of conventional drier drums, or can rolls are illustrated in the following U.S. Pat. Nos: 3,118,743 that issued to Malmstrom, et al Jan. 21, 1964; 3,116,985 that issued to Kraus Jan. 7, 1964; 3,217,426 that issued to Barnsheidt, et al Nov. 16, 1965; 3,248,803 to Kirkorian that issued May 3, 1966; 3,911,595 that issued to Lande Oct. 14, 1975; 2,374,745 that issued to Grimm May 1, 1945; 2,779,104 to Sims on Jan. 29, 1957; and 2,817,908 that issued to Hornbostel Dec. 31, 1957.

U.S. Pat. No. 1,076,330 that issued to Thompson Oct. 21, 1913, discloses radiative insulation means comprising the formation of a dead air space exterior of the head which is stated to be an improvement over the earlier method of covering the head with a layer of magnesia that could then be covered with a metal sheet. U.S. Pat. No. 1,640,855 that issued to Shlick Aug. 30, 1927, discloses means for covering head members with insulating material to reduce radiative losses and protect workers from the danger of becoming entangled with protruding bolts from the heads.

SUMMARY OF THE INVENTION

This invention, for which I desire to secure letters patent, is defined as being in a sheet or web processing machine having multiple cylindrical can rolls for drying a continuous sheet of materials, said can rolls:

A. being comprised of a cylindrical shell of a finite wall thickness having ends that are enclosed with head members that are bolted with head bolt means into the wall thickness circumferentially around the shell to provide a fluid tight seal, said head bolt means protruding from said head member to provide a protruding body bolt, and shaft means extending from each head member in axial alignment with said cylindrical shell to provide a rotatable can roll;

B. having associated internal heating means for heating the rolls with high pressure steam;

C. having head member insulating means detachably affixed to at least one of the head members with clip means and operatively associated with at least one of the head members of A, said insulating means comprising:

(1) outer rim means having an inboard edge disposed and located closely adjacent to the circumferential portion of the head member and an outboard edge of a diameter not exceeding the diameter of the head member, said outer rim means having a substantial width and further having heat insulating material adjacent to an interior portion of the width;

(2) segmental face heat insulating means affixed to the outboard edge of the outer rim, said segmental face heat insulating means having heat insulating material adjacent to its inboard portion and being formed of at least two semicircular segments adapted to allow the shaft means to pass therethrough, said segments being held together in a sealing relationship with splice plate means; said outer rim means of (1) and its insulating material in conjunction with the segmental face heat insulating means and its insulating material defining an air space between the insulating materials of (1) and (2) and the associated head member;

(3) clip means for detachably affixing the head member insulating means to the head member, the improvement of clip means which comprises a body bolt adapter for affixing a nut to the protruding body bolt while providing for limited floating motion of the nut to facilitate alignment and mating of the nut with an external bolt operatively associated with the head member insulating means, comprising:

(a) a body member comprising body member wall means disposed and adapted to encompass the protruding body bolt and cap means attached atop the wall means to define an interior cavity adapted to receive the protruding body bolt, said body member having associated grip means adapted to bear against a side of the protruding body bolt that extends into the cavity to rigidly affix the body member to the protruding body bolt; and (b) nut retainer means rigidly affixed atop the cap means on a side of the cap means away from the interior cavity of the body member, said nut retainer means being adapted to loosely receive and retain a floating nut that is adapted to receive and mate with the external bolt from the head member insulating means, the nut retainer means having a passageway for the external bolt to extend into the nut retainer means and mate with the retained nut.

The body bolt adapter useful for attaching the head member insulating means to the existing protruding head bolts is defined as:

A. A body member comprising body member wall means disposed and adapted to encompass the protruding body bolt and cap means attached atop the wall means to define an interior cavity adapted to receive the protruding body bolt, said body member having associated grip means adapted to bear against a side of a protruding body bolt that extends into the cavity to rigidly affix the body member to the protruding body bolt; and B. Nut retainer means rigidly affixed atop the cap means on a side of the cap means away from the interior cavity of the body member, said nut retainer means being adapted to loosely receive and retain a floating nut that is adapted to receive and mate with an external bolt from an object that is to be attached to the protruding body bolt, the nut retainer means having a passageway for the external bolt to extend into the nut retainer means and mate with the retained nut.

It is preferred that the grip means comprises screw means passing through the wall member that is disposed and adapted to bear against a protruding body bolt within the cavity to rigidly affix the body member to the protruding body bolt.

The nut retainer means of the body bolt adapter preferably comprises nut retainer wall means and associated retainer cap means defining a nut retainer cavity disposed and adapted to at least partially encompass the nut to be received and associated bendable flange means adapted to be bent to more completely enclose and retain a received nut within the retainer cavity.

In its broader scope, the improvement in the clip means is defined as comprising:

(a) protruding head bolt encompassing means adapted to substantially encompass each of the protruding head bolts;

(b) grip means operatively associated with each of the encompassing means adapted to detachably grip and affix the encompassing means to each of the protruding head bolts;

(d) anchor bolt means operatively associated with and connected to the head insulating assembly means and extending therefrom toward each of said encompassing means and being closely adjacent to and in substantial alignment with each of said protruding head bolts; and (e) anchor bolt receptor means operatively associated with each of the encompassing means and adapted to receive and threadably mate with the protruding anchor bolt means extending from the head insulating assembly means.

BRIEF DESCRIPTION OF THE DRAWINGS

FIG. 4 is an end view of the modified can roll of FIG. 3, the shaft means being 16.

FIG. 5 is a broken away cross section of the modified head of FIG. 3.

FIG. 6 is a front view of an angle clip 22 useful for attaching the modifications of this invention to existing head bolts 19.

DETAILED DESCRIPTON OF THE INVENTION

Figure 1:
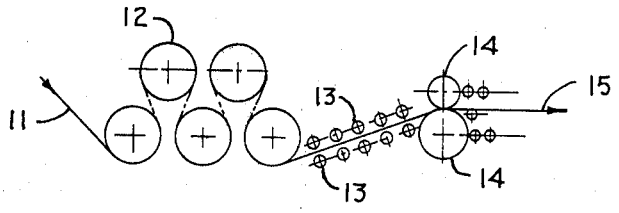
FIG. 1 is a diagramatic schematic illustration of a web processing machine dryer portion, showing an end view of heated can rolls 12.
Figure 2:
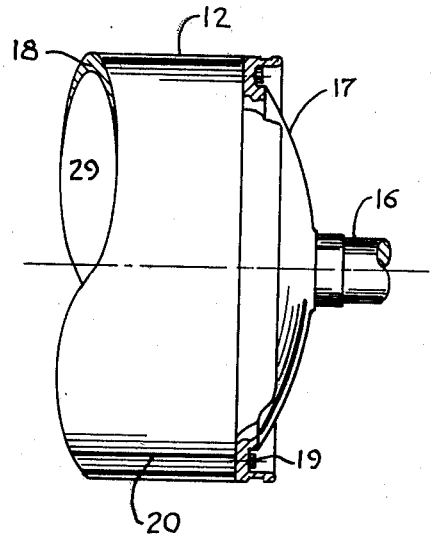
FIG. 2 is a side elevational view of an end portion of a conventional can roll showing its associated head member 17, partially broken away to show the interior of shell 29 and head bolt 19.
Figure 3:
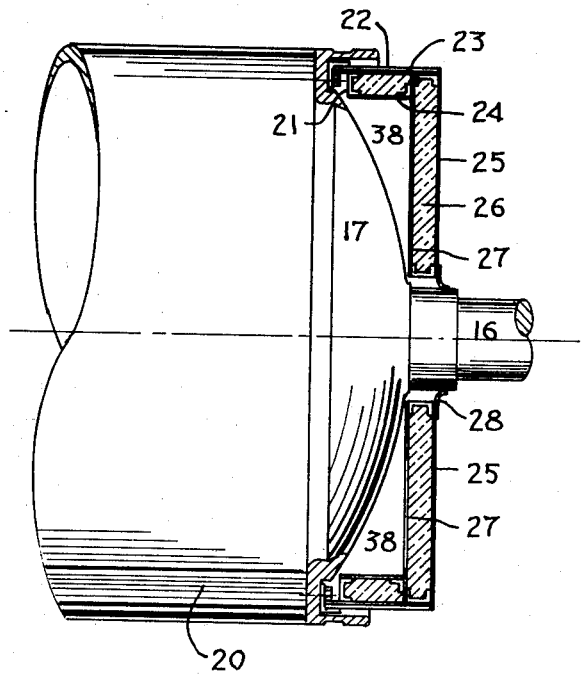
FIG. 3 is a similar view of the conventional can roll of FIG. 2 after having been modified with the addition of the apparatus of this invention that is shown in cross section on the right hand side of head 17.

The invention is best described with reference to the figures of the drawings, wherein the same reference characters refer to the same parts throughout the figures.

A wet web to be dried 11, passes around can rolls 12, through guide or nip rolls 13, and out through discharge rolls 14 as a dried product in the form of a coherent web of sheet 15.

The shell 18 of the can roll has internal cavity 29 and exterior drying surface 20. Head 17 encloses the end of the cavity 29 and is bolted into the shell wall 18 with head bolts 19 that are spaced circumferentially around shell 18. Shaft means 16 is associated with head 17 to provide rotational means.

The head modifications to provide the improved highly thermal efficient head of this invention are illustrated in FIGS. 3, 4, 5, 6, 7, and 8. Angle clips 22 are affixed to head bolts 19 to provide means for retaining outer rim 23 in a sealing relationship with head 17. Head bolts 19 are received within space 33 of the angle clips 22 and portion 34 of the clip engages the outer rim 23 which is secured thereto by welding or other suitable fastening means. Portion 32 of the clip engages head 17.

Outer rim 23 has insulating material 26 of a low heat conductivity, such as ceramic fibers, held adjacent to its interior width portion.

The outboard end of outer rim 23 is enclosed with a number of parts comprising segmental heat insulating means comprising face plate 25 having two semicircular sections to enclose the outer rim 23 and receive shaft means 16 passing therethrough, and being held together with splice plate means 31 detachably affixed with bolts and associated "rivnuts" or other suitable means 30 to face plate 25. Face Plate 25 is rigidly secured to outer rim 23 with clips 29 spaced around the rim 23. Sealing material 28, such as urethane rubber is affixed to face plate 25 to seal the shaft periphery and face plate 25.

Insulating material 26 is affixed adjacent to the inboard side of face plate 25, providing a dead air space 38 between the face plate 25 and its insulation 26, and the exterior of head 17.

Inner rim 24 is spaced from and rigidly attached to outer rim 23 with channel spacers 21 and the associated rivets or other suitable fastening means.

A second set of semicircular sheets 27 held together with splice plate means 31 and bolts 30 is arranged inboard of face plate 25 to provide a cavity for holding insulating material 26. The plates are spaced from each other with channel clips 29 and 21 and associated rivet or bolt means 29 and 37. Angle clip 35 and associated fastening means affixes inner rim 24 to back plate 27 to provide a rigid structure.

Body bolt adapter 39 is comprised of body member 42 and nut retainer means 47. The body member 42 is comprised of body member wall means 43. cap means 44 affixed atop wall means 43, which defines interior cavity 45 to receive the protruding body bolt 19 of the head member. Set screws 46, serve as grip means to detachably affix bolt 19 to the body bolt adapter 39. External bolt 41 from the insulator assembly is aligned with and mates with floating nut 40 that is held within nut retainer means 47. Bolt 41 passes through passageway 48 of nut retainer means 47.

Nut retainer means 47 is comprised of nut retainer wall means 49 with associated cap means 50 and associated bendable flange means 51 to allow for insertion of nut 40 into nut retainer means 47. The parts of the body bolt adapter can be separately cast and welded or cast as one piece.

Set screws 46, acting as grip means for holding rigidly the adapter 39 to the protruding body bolt 19, could be substituted with other types of biasing grip means, such as spring means or an expandable O-Ring—to name a few It is preferred that screw means such as a bolt and an associated "rivnut" be used at appropriate locations as the fastening means to facilitate removal of the face plate and back plate to provide easy access to the head for routine maintenance of the can roll.

Outer rim 23 typically has a width of about 7 inches and the inner rim about 5.5 inches, but these can vary to accommodate specific head designs. The thickness of the insulating material is typically about 1.5 inches.

The splice plates and rim support are preferably of stainless steel and the remainder of the parts of aluminum.

The energy savings resulting from the practice of this invention are evaluated on an internally steam heated 12 foot diameter can roll of a papermaking machine under various operating conditions. The insulation thickness is about 1.25 inches and comprised of a ceramic fiber blanket having a specific heat at 1800° F. mean of 0.255 Btu/lb./°F.

Figure 7:
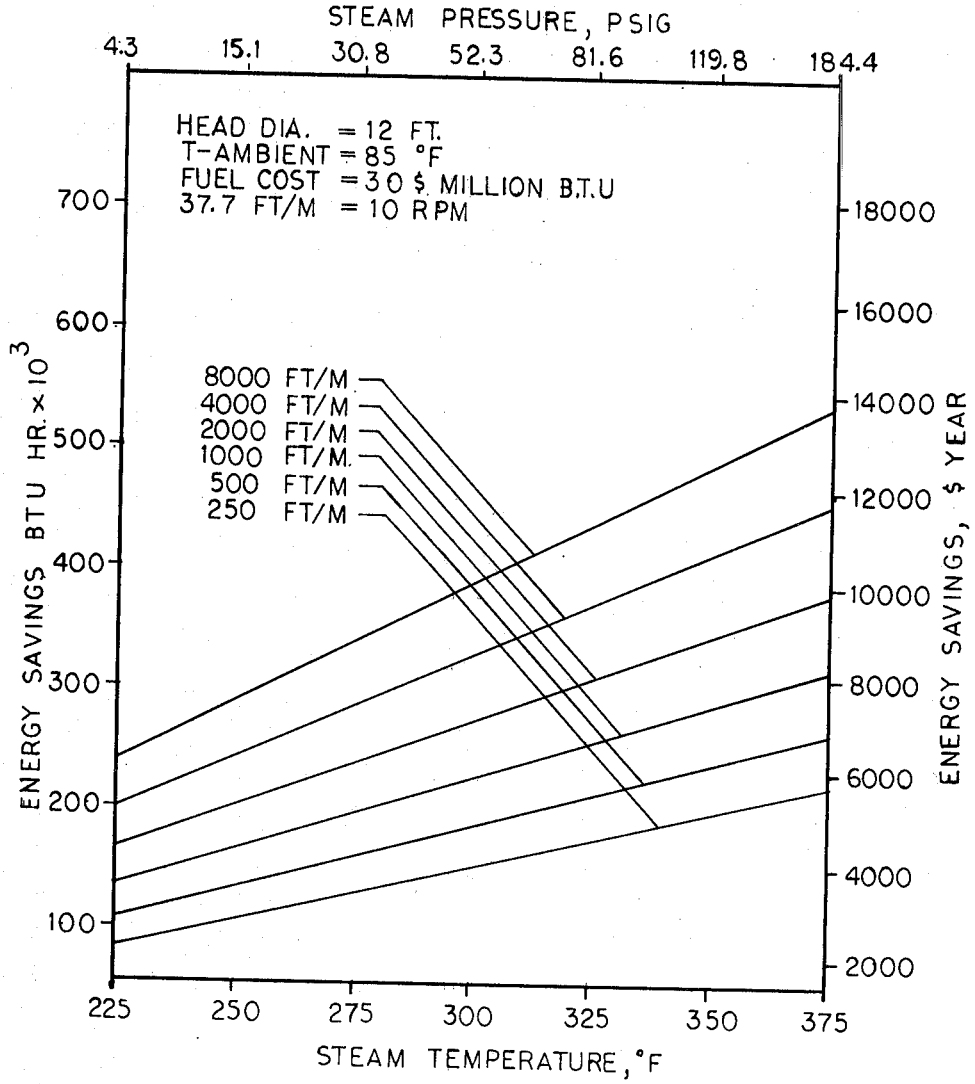
FIG. 7 is a graphical representation of a specific embodiment of this invention showing energy savings at various operating conditions for a 12 foot diameter can roll.
Figure 8:
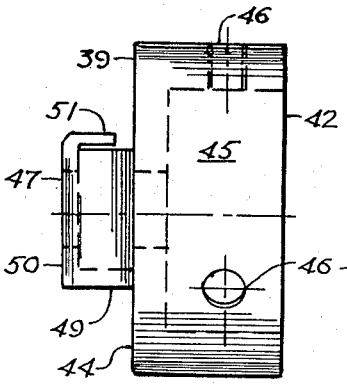
FIG. 8 is a side elevational view of the body bolt adapter of this invention. The hidden interior surfaces are indicated with broken lines for greater clarity.
Figure 9:
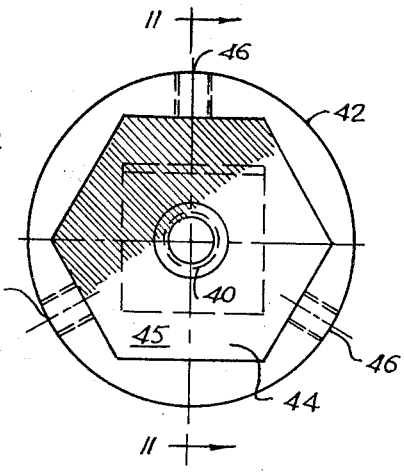
FIG. 9 is an end view of the body bolt adapter of this invention, viewed from the end having interior cavity 45 for receiving the existing protruding body bolt from the head member. Hidden interior surfaces are indicated with broken lines.
Figure 10:
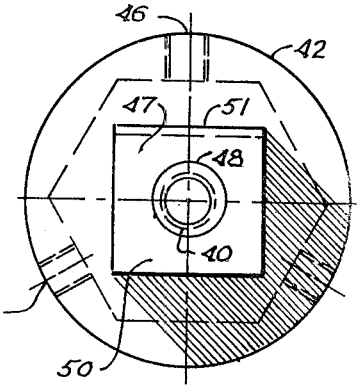
FIG. 10 is an end view of the body bolt adapter of this invention, viewed from the end having nut retainer means 47. The interior parts and surfaces are indicated with broken lines.
Figure 11:
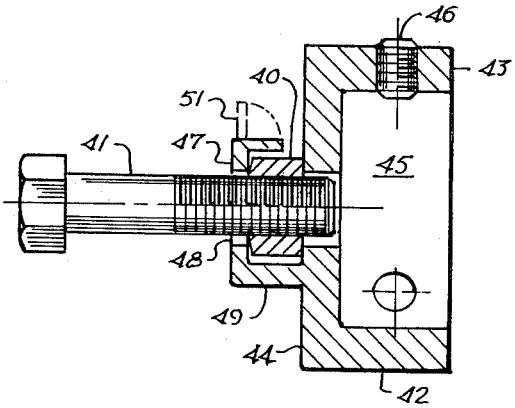
FIG. 11 is a cross-sectional view taken through line 11—11 of the body bolt adapter of FIG. 9.
Figure 12:
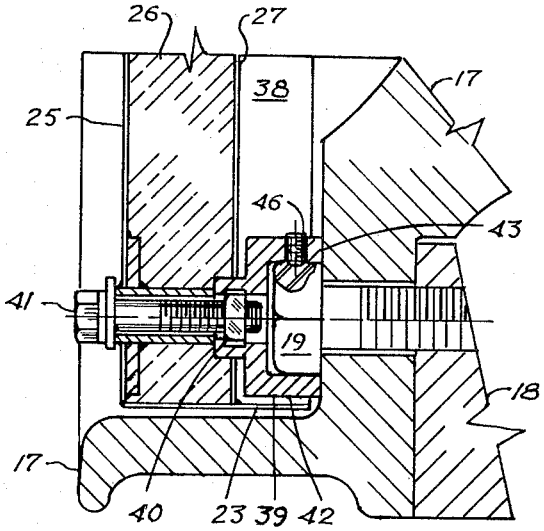
FIG. 12 is a cross-sectional view of an end portion of a conventional can roll with associated concave type head member 17 having the body bolt adapter and insulating assembly of this invention installed. Body bolt adapter 39 is affixed to the protruding head bolt 19 and attached to the head insulating member through external bolt 41.

The operating conditions and the resulting savings are set forth in FIG. 7.

A typical desirable insulating material is a ceramic fiber blanket sold by Babcock and Wilcox under the registered trademark "Kaowool".

In its broader definition, body member 42, including wall means 43 and cap means 44 which define cavity 45, is known functionally as protruding head bolt encompassing means because it is adapted to substantially encompass protruding head bolts 19.

Likewise, external bolt 41 that is operatively associated with and connected to the insulator assembly means is functionally referred to as anchor bolt means.

Nut retainer means 47, in conjunction with floating nut 40, is functionally defined as anchor bolt receptor means because the combination of parts is adapted and disposed to threadably mate with and receive the anchor bolt means.

I claim:

1. A body bolt adapter for affixing a nut to a protruding body bolt while providing for limited floating motion of the nut to: facilitate alignment of the nut with an external bolt to be received from an object that is to be attached to the protruding body bolt, comprising:

A. a body member comprising body member wall means disposed and adapted to encompass the protruding body bolt and cap means attached atop the wall means to define an interior cavity adapted to receive the protruding body bolt, said body member having associated grip means adapted to bear against a side of a protruding body bolt that extends into the cavity to rigidly affix the body member to the protruding body bolt; and B. nut retainer means rigidly affixed atop the cap means on a side of the cap means away from the interior cavity of the body member, said nut retainer means being adapted to loosely receive and retain a floating nut that is adapted to receive and mate with an external bolt from an object that is to be attached to the protruding body bolt, the nut retainer means having a passageway for the external bolt to extend into the nut retainer means and mate with the retained nut.

2. The body bolt adapter as defined in claim 1, wherein said grip means comprises screw means passing through the wall member that is disposed and adapted to bear against a protruding body bolt within the cavity to rigidly affix the body member to the protruding body bolt.

3. The body bolt adapter as defined in claim 1, wherein said grip means comprises a pair of opposed set screws passing through the wall means that are disposed and adapted to bear against opposite sides of a protruding body bolt to rigidly affix the body member to the protruding body bolt.

4. The body bolt adapter as defined in claim 1, wherein the nut retainer means of 1(B) comprises nut retainer wall means and associated retainer cap means defining a nut retainer cavity disposed and adapted to at least partially encompass the nut to be received and associated bendable flange means adapted to be bent to more completely enclose and retain a received nut within the retainer cavity.

5. In a web processing machine having multiple cylindrical can rolls for drying a continuous web of fibers or filaments, said can rolls:

A. being comprised of a cylindrical shell of a finite wall thickness having ends that are enclosed with head members that are bolted with head bolt means into the wall thickness circumferentially around the shell to provide a fluid tight seal, said head bolt means protruding from said head member to provide a protruding body bolt, and shaft means extending from each head member in axial alignment with said cylindrical shell to provide a rotatable can roll;

B. having associated internal heating means for heating the rolls with high pressure steam;

C. having head member insulating means detachably affixed to at least one of the head members with clip means and operatively associated with at least one of the head members of A, said insulating means comprising:

(1) outer rim means having an inboard edge disposed and located closely adjacent to the circumferential portion of the head member and an outboad edge of a diameter not exceeding the diameter of the head member, said outer rim means having a substantial width and further having heat insulating material adjacent to an interior portion of the width;

(2) segmental face heat insulating means affixed to the outboard edge of the outer rim, said segmental face heat insulating means having heat insulating material adjacent to its inboard portion and being formed of at least two semicircular segments adapted to allow the shaft means to pass therethrough, said segments being held together in a sealing relationship with splice plate means; said outer rim means of (1) and its insulating material in conjunction with the segmental face heat insulating means and its insulating material defining an air space between the insulating materials of (1) and (2) and the associated head member;

(3) clip means for detachably affixing the head member insulating means to the head member, the improvement of clip means which comprises a body bolt adapter for affixing a nut to the protruding body bolt while providing for limited floating motion of the nut to facilitate alignment and mating of the nut with an external bolt operatively associated with the head member insulating means, comprising:

(a) a body member comprising body member wall means disposed and adapted to encompass the protruding body bolt and cap means attached atop the wall means to define an interior cavity adapted to receive the protruding body bolt, said body member having associated grip means adapted to bear against a side of the protruding body bolt that extends into the cavity to rigidly affix the body member to the protruding body bolt; and (b) nut retainer means rigidly affixed atop the cap means on a side of the cap means away from the interior cavity of the body member, said nut retainer means being adapted to loosely receive and retain a floating nut that is adapted to receive and mate with the external bolt from the head member insulating means, the nut retainer means having a passageway for the external bolt to extend into the nut retainer means and mate with the retained nut.

6. The web processing machine as defined in claim 5, wherein said grip means of the body bolt adapter comprises screw means passing through the wall member that is disposed and adapted to bear against the protruding body bolt located within the cavity to rigidly affix the body member to the protruding body bolt.

7. The web processing machine as defined in claim 5, wherein said grip means of the bolt adapter comprises a pair of opposed set screws passing through the wall means that are disposed and adapted to bear against opposite sides of the protruding body bolt to rigidly affix the body member to the protruding body bolt.

8. The web processing machine as defined in claim 5, wherein the nut retainer means of the body bolt adapter comprises nut retainer wall means and associated retainer cap means defining a nut retainer cavity disposed and adapted to at least partially encompass the nut to be received and associated bendable flange means adapted to be bent to more completely enclose and retain the received nut within the retainer cavity.

* * * * *